US005502288A

United States Patent [19]

Cogen et al.

[11] Patent Number: 5,502,288

[45] Date of Patent: Mar. 26, 1996

[54] TELEPHONE CABLES

[75] Inventors: Jeffrey M. Cogen, Flemington; Michael J. Keogh; Geoffrey D. Brown, both of Bridgewater, all of N.J.

[73] Assignee: Union Carbide Chemicals & Plastics Technology Corporation, Danbury, Conn.

[21] Appl. No.: 219,995

[22] Filed: Mar. 30, 1994

[51] Int. Cl.[6] ..... H01B 7/28

[52] U.S. Cl. ..... 174/113 R; 174/23 C

[58] Field of Search ..... 174/113 R, 23 R, 174/23 C

[56] References Cited

U.S. PATENT DOCUMENTS

| | | | |
|---|---|---|---|
| 3,717,716 | 2/1973 | Biskeborn et al. | 174/25 R |
| 3,775,548 | 11/1973 | Zinser, Jr. et al. | 174/23 C |
| 3,888,709 | 6/1975 | Burk | 156/48 |
| 3,904,582 | 9/1975 | Hansen | 260/45.8 N |
| 3,996,413 | 12/1976 | Foord et al. | 174/23 C |
| 4,246,435 | 1/1981 | Thompson | 174/23 C |
| 4,701,016 | 10/1987 | Gartside, III et al. | 174/70 R |
| 4,853,426 | 8/1989 | Chatterjee | 524/100 |
| 5,064,878 | 11/1991 | Chatterjee | 523/205 |
| 5,100,940 | 3/1992 | Wicher | 524/94 |
| 5,348,669 | 9/1994 | Brauer et al. | 252/28 |

FOREIGN PATENT DOCUMENTS

| | | |
|---|---|---|
| 281401 | 8/1990 | Germany . |
| 285608 | 12/1990 | Germany . |
| 1593902 | 7/1981 | United Kingdom . |

OTHER PUBLICATIONS

DiBattista et al, New Antioxidant/Metal Deactivator etc., Soc. Plast. Eng., Tech. Paper, vol. 21, 1975, pp. 280 to 282.

Chan et al, Stabilization Systems etc., Soc. Plast. Eng., Tech. Paper, vol. 21, 1975, pp. 292 to 294.

Von Gentzkow et al, J. Appl. Polymer Science, Appl. Polymer Symp. 35, 1979, pp. 173 to 182.

Miller et al, Persistent antioxidants etc., Rubber World, 200 (15) Aug., 1989, pp. 13 to 16 and 18 to 23.

*Primary Examiner*—Morris H. Nimmo

*Attorney, Agent, or Firm*—Saul R. Bresch

[57] ABSTRACT

An article of manufacture comprising, as a first component, a plurality of electrical conductors, each surrounded by one or more layers comprising a mixture of (i) one or more polyolefins; (ii) a first antioxidant selected from the group consisting of poly(2,2,4-trimethyl-1,2-dihydroquinoline); the reaction product of diphenylamine and acetone; the reaction product of diphenylamine, acetone, and formaldehyde; and mixtures thereof; and (iii) a second antioxidant selected from the group consisting of 2,2'-oxalyldiamidobis[ethyl-3-(3,5-di-tert-butyl-4-hydroxyphenyl)-propionate]; 1,2-bis(3,5-di-tert-butyl-4-hydroxyhydrocinnamoyl)-hydrazine; and mixtures thereof; and, as a second component, hydrocarbon cable filler grease within the interstices between said surrounded conductors.

9 Claims, 1 Drawing Sheet

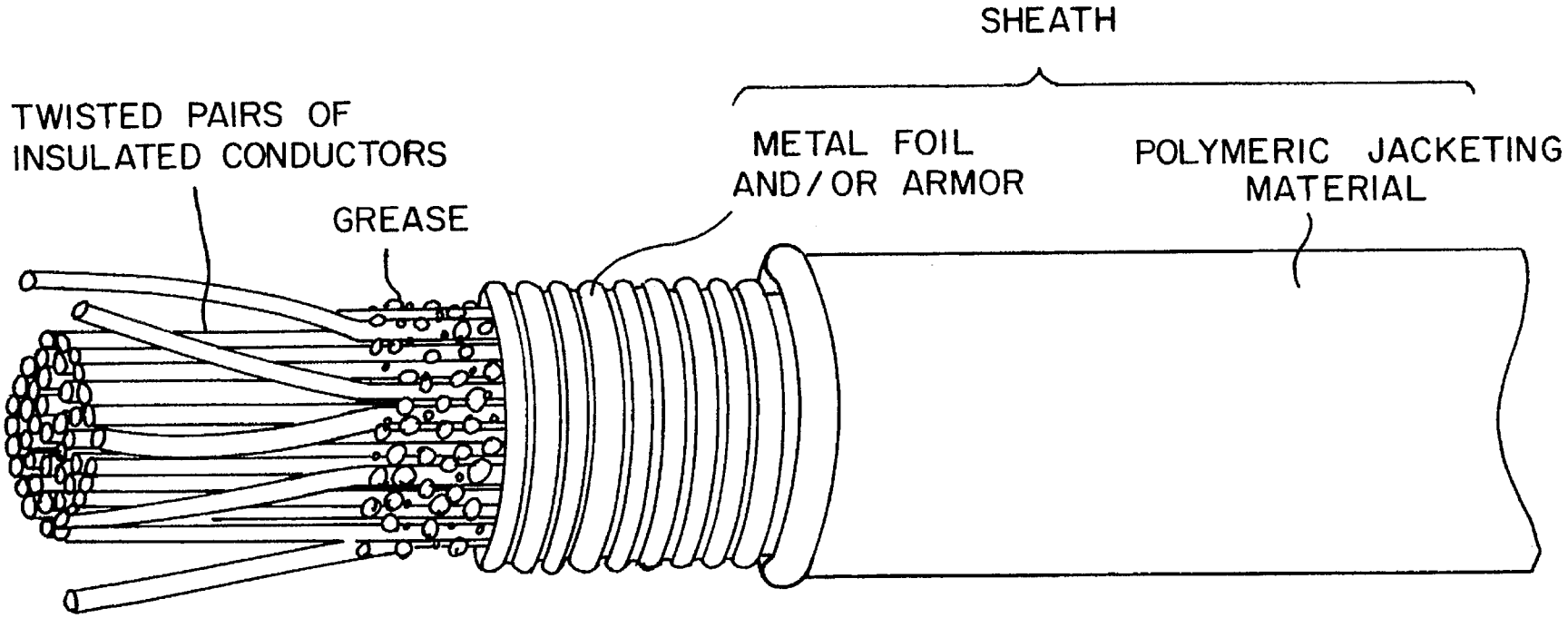
SHEATH
POLYMERIC JACKETING MATERIAL
METAL FOIL AND/OR ARMOR
GREASE
TWISTED PAIRS OF INSULATED CONDUCTORS

TELEPHONE CABLES

TECHNICAL FIELD

This invention relates to wire and cable and the insulation and jacketing therefor and, more particularly, to telephone cable.

BACKGROUND INFORMATION

A typical telephone cable is constructed of twisted pairs of metal conductors for signal transmission. Each conductor is insulated with a polymeric material. The desired number of transmission pairs is assembled into a circular cable core, which is protected by a cable sheath incorporating metal foil and/or armor in combination with a polymeric jacketing material. The sheathing protects the transmission core against mechanical and, to some extent, environmental damage.

Of particular interest are the grease-filled telephone cables. These cables were developed in order to minimize the risk of water penetration, which can severely upset electrical signal transmission quality. A watertight cable is provided by filling the air spaces in the cable interstices with a hydrocarbon cable filler grease. While the cable filler grease extracts a portion of the antioxidants from the insulation, the watertight cable will not exhibit premature oxidative failure as long as the cable maintains its integrity.

In the cable transmission network, however, junctions of two or more watertight cables are required and this joining is often accomplished in an outdoor enclosure known as a pedestal (an interconnection box). Inside the pedestal, the cable sheathing is removed, the cable filler grease is wiped off, and the transmission wires are interconnected. The pedestal with its now exposed insulated wires is usually subjected to a severe environment, a combination of high temperature, air, and moisture. This environment together with the depletion by extraction of those antioxidants presently used in grease-filled cable can cause the insulation in the pedestal to exhibit premature oxidative failure. In its final stage, this failure is reflected in oxidatively embrittled insulation prone to cracking and flaking together with a loss of electrical transmission performance.

To counter the depletion of antioxidants, it has been proposed to add high levels of antioxidants to the polymeric insulation. However, this not only alters the performance characteristics of the insulation, but is economically unsound in view of the high cost of antioxidants. There is a need, then, for antioxidants which will resist cable filler grease extraction to the extent necessary to prevent premature oxidative failure and ensure the 30 to 40 year service life desired by industry.

BRIEF DESCRIPTION OF THE DRAWING

The sole FIGURE of the drawing is a schematic representation of the type of cable construction, which would contain the above defined antioxidants in its insulation.

DISCLOSURE OF THE INVENTION

An object of this invention, therefore, is to provide a grease-filled cable construction containing antioxidants which will resist extraction and be maintained in the cable insulation at a satisfactory stabilizing level. Other objects and advantages will become apparent hereinafter.

According to the invention, an article of manufacture has been discovered, which meets the above object, comprising, as a first component, a plurality of electrical conductors, each surrounded by one or more layers comprising a mixture of (i) one or more polyolefins; (ii) a first antioxidant selected from the group consisting of poly(2,2,4-trimethyl-1,2-dihydroquinoline); the reaction product of diphenylamine and acetone; the reaction product of diphenylamine, acetone, and formaldehyde; and mixtures thereof; and (iii) a second antioxidant selected from the group consisting of 2,2'-oxalyldiamido-bis[ethyl- 3-(3,5-di-tert-butyl-4-hydroxyphenyl)-propionate]; 1,2-bis(3,5-di-tert-butyl-4-hydroxyhydrocinnamoyl)-hydrazine; and mixtures thereof; and, as a second component, hydrocarbon cable filler grease within the interstices between said surrounded conductors.

In one other embodiment, the article of manufacture comprises first and second components; however, the mixture of the first component contains absorbed hydrocarbon cable filler grease or one or more of the hydrocarbon constituents thereof and, in another embodiment, the article of manufacture is comprised only of the first component wherein the mixture contains hydrocarbon cable filler grease or one or more of the hydrocarbon constituents thereof.

DESCRIPTION OF THE PREFERRED EMBODIMENTS

The polyolefins used in this invention are generally thermoplastic resins, which are crosslinkable. They can be homopolymers or copolymers produced from two or more comonomers, or a blend of two or more of these polymers, conventionally used in film, sheet, and tubing, and as jacketing and/or insulating materials in wire and cable applications. The monomers useful in the production of these homopolymers and copolymers can have 2 to 20 carbon atoms, and preferably have 2 to 12 carbon atoms. Examples of these monomers are alpha-olefins such as ethylene, propylene, 1-butene, 1-hexene, 4-methyl-1-pentene, and 1-octene; unsaturated esters such as vinyl acetate, ethyl acrylate, methyl acrylate, methyl methacrylate, t-butyl acrylate, n-butyl acrylate, n-butyl methacrylate, 2-ethylhexyl acrylate, and other alkyl acrylates; diolefins such as 1,4-pentadiene, 1,3-hexadiene, 1,5-hexadiene, 1,4-octadiene, and ethylidene norbornene, commonly the third monomer in a terpolymer; other monomers such as styrene, p-methyl styrene, alpha-methyl styrene, p-chloro styrene, vinyl naphthalene, and similar aryl olefins; nitriles such as acrylonitrile, methacrylonitrile, and alpha-chloroacrylonitrile; vinyl methyl ketone, vinyl methyl ether, vinylidene chloride, maleic anhydride, vinyl chloride, vinylidene chloride, vinyl alcohol, tetrafluoroethylene, and chlorotrifluoroethylene; and acrylic acid, methacrylic acid, and other similar unsaturated acids.

The homopolymers and copolymers referred to can be nonhalogenated, or halogenated in a conventional manner, generally with chlorine or bromine. Examples of halogenated polymers are polyvinyl chloride, polyvinylidene chloride, and polytetrafluoroethylene. The homopolymers and copolymers of ethylene and propylene are preferred, both in the non-halogenated and halogenated form. Included in this preferred group are terpolymers such as ethylene/propylene/diene monomer rubbers.

Other examples of ethylene polymers are as follows: a high pressure homopolymer of ethylene; a copolymer of ethylene and one or more alpha-olefins having 3 to 12 carbon atoms; a homopolymer or copolymer of ethylene having a hydrolyzable silane grafted to their backbones; a copolymer of ethylene and a hydrolyzable silane; or a copolymer of an alpha-olefin having 2 to 12 carbon atoms and an unsaturated ester having 4 to 20 carbon atoms, e.g., an ethylene/ethyl acrylate or vinyl acetate copolymer; an ethylene/ethyl acrylate or vinyl acetate/hydrolyzable silane terpolymer; and ethylene/ethyl acrylate or vinyl acetate copolymers having a hydrolyzable silane grafted to their backbones.

With respect to polypropylene: homopolymers and copolymers of propylene and one or more other alpha-olefins wherein the portion of the copolymer based on propylene is at least about 60 percent by weight based on the weight of the copolymer can be used to provide the polyolefin of the invention. The polypropylene can be prepared by conventional processes such as the process described in U.S. Pat. No. 4,414,132. The alpha-olefins in the copolymer are preferably those having 2 or 4 to 12 carbon atoms.

The homopolymer or copolymers can be crosslinked or cured with an organic peroxide, or to make them hydrolyzable, they can be grafted with an alkenyl trialkoxy silane in the presence of an organic peroxide which acts as a free radical generator or catalyst. Useful alkenyl trialkoxy silanes include the vinyl trialkoxy silanes such as vinyl trimethoxy silane, vinyl triethoxy silane, and vinyl triisopropoxy silane. The alkenyl and alkoxy radicals can have 1 to 30 carbon atoms and preferably have 1 to 12 carbon atoms.

The homopolymers or copolymers of ethylene wherein ethylene is the primary comonomer and the homopolymers and copolymers of propylene wherein propylene is the primary comonomer may be referred to herein as polyethylene and polypropylene, respectively.

Hydrolyzable polymers can be cured with moisture in the presence of a conventional silanol condensation catalyst such as dibutyltin dilaurate, dioctyl tin maleate, stannous acetate, and stannous octoate.

The polyethylenes can have a density in the range of about 0.850 to about 0.970 gram per cubic centimeter. The density is preferably in the range of about 0.926 to about 0.970 gram per cubic centimeter. Medium and high density polyethylenes are preferred.

Hydrocarbon cable filler grease is a mixture of hydrocarbon compounds, which is semisolid at use temperatures. It is known industrially as "cable filling compound". A typical requirement of cable filling compounds is that the grease has minimal leakage from the cut end of a cable at a 60° C. or higher temperature rating. Another typical requirement is that the grease resist water leakage through a short length of cut cable when water pressure is applied at one end. Among other typical requirements are cost competitiveness; minimal detrimental effect on signal transmission; minimal detrimental effect on the physical characteristics of the polymeric insulation and cable sheathing materials; thermal and oxidative stability; and cable fabrication processability.

Cable fabrication can be accomplished by heating the cable filling compound to a temperature of approximately 100° C. This liquefies the filling compound so that it can be pumped into the multiconductor cable core to fully impregnate the interstices and eliminate all air space. Alternatively, thixotropic cable filling compounds using shear induced flow can be processed at reduced temperatures in the same manner. A cross section of a typical finished grease-filled cable transmission core is made up of about 52 percent insulated wire and about 48 percent interstices in terms of the areas of the total cross section. Since the interstices are completely filled with cable filling compound, a filled cable core typically contains about 48 percent by volume of cable filler.

The cable filling compound or one or more of its hydrocarbon constituents enter the insulation through absorption from the interstices. Generally, the insulation absorbs about 3 to about 30 parts by weight of cable filling compound or one or more of its hydrocarbon constituents, in toto, based on 100 parts by weight of polyolefin. A typical absorption is in the range of a total of about 5 to about 25 parts by weight per 100 parts by weight of polyolefin.

It will be appreciated by those skilled in the art that the combination of resin, cable filling compound constituents, and antioxidants in the insulation is more difficult to stabilize than an insulating layer containing only resin and antioxidant, and no cable filling compound constituent.

Examples of hydrocarbon cable filler greases are petrolatum; petrolatum/polyolefin wax mixtures; oil modified thermoplastic rubber (ETPR or extended thermoplastic rubber); paraffin oil; naphthenic oil; mineral oil; the aforementioned oils thickened with a residual oil, petrolatum, or wax; polyethylene wax; mineral oil/rubber block copolymer mixture; lubricating grease; and various mixtures thereof, all of which meet industrial requirements similar to those typified above.

Generally, cable filling compounds extract insulation antioxidants and, as noted above, are absorbed into the polymeric insulation. Since each cable filling compound contains several hydrocarbons, both the absorption and the extraction behavior are preferential toward the lower molecular weight hydrocarbon wax and oil constituents. It is found that the insulation composition with its antioxidant not only has to resist extraction, but has to provide sufficient stabilization (i) to mediate against the copper conductor, which is a potential catalyst for insulation oxidative degradation, (ii) to counter the effect of residuals of chemical blowing agents present in cellular and cellular/solid (foam/skin) polymeric foamed insulation; and (iii) to counter the effect of absorbed constituents from the cable filling compound.

The first and second antioxidants are known antioxidants and the second antioxidant is a known metal deactivator. It is found that this mixture of antioxidants substantially resists the effects of extraction by grease as opposed to each alone, in particular, and other antioxidants in general. The amount of the mixture of first and second antioxidants typically used in the polyolefin is in the range of about 0.06 to about 2 parts by weight based on 100 parts by weight of polyolefin; preferably, the amount of first antioxidant is in the range of about 0.01 to about 1 part by weight and the second antioxidant is in the range of about 0.05 to about 1 part by weight. Optionally, about 0.05 to about 2 parts of conventional blowing agent can be included to provide foam rather than solid insulation. The mixture can be used in combination with disulfides, phosphites, hindered phenols, and hindered amines, as well as other conventional primary antioxidants in ratios of about 10:1 to about 1:10 for additional oxidative and thermal stability, but, of course, it must be determined to what extent these latter compounds are extracted by the grease since this could affect the efficacy of the combination.

The following conventional additives can be added in conventional amounts if desired: ultraviolet absorbers, antistatic agents, pigments, dyes, fillers, slip agents, fire retardants, stabilizers, crosslinking agents, halogen scavengers, smoke inhibitors, crosslinking boosters, processing aids, e.g., metal carboxylates, lubricants, plasticizers, viscosity control agents, and foaming or blowing agents such as azodicarbonamide. The fillers can include, among others, magnesium hydroxide and alumina trihydrate. As noted, other antioxidants and/or metal deactivators can also be used, but for these or any of the other additives, resistance to grease extraction must be considered.

Additional information concerning grease-filled cable can be found in Eoll, *The Aging of Filled Cable with Cellular Insulation*, International Wire & Cable Symposium Proceeding 1978, pages 156 to 170, and Mitchell et al, *Development, Characterization, and Performance of an Improved Cable Filling Compound,* International Wire & Cable Symposium Proceeding 1980, pages 15 to 25. The latter publication shows a typical cable construction on page 16 and gives additional examples of cable filling compounds.

The patents and publications mentioned in this specification are incorporated by reference herein.

The invention is illustrated by the following examples.

EXAMPLES 1 TO 14

10 mil polyethylene plaques are prepared for testing. The polyethylene is a copolymer of ethylene and 1-hexene. The density of the copolymer is 0.945 gram per cubic centimeter and the melt index is 0.75 gram per 10 minutes.

A laboratory procedure simulating the grease filled cable application is used to demonstrate performance. Polyethylene samples incorporating specified antioxidants are prepared using standard melt mixing techniques. In particular, there is a final melt mixing on a laboratory Brabender™ type mixer followed by preparation of the test plaques (approximately 0.010 inch thick) using a compression molding press at 150° C. with ASTM D-1928 as a guideline. Initial oxygen induction time (OIT) is measured on these test plaques.

A supply of hydrocarbon cable filler grease is heated to about 80° C. and well mixed to ensure uniformity. A supply of 30 millimeter dram vials are then each filled to approximately 25 millimeters with the cable filler grease. These vials are then cooled to room temperature for subsequent use. An oil extended thermoplastic rubber (ETPR) type cable filler grease is the hydrocarbon cable filler grease used in these examples. It is a typical cable filling compound.

Each ten mil test plaque is then cut to provide about twenty approximately one-half inch square test specimens. Before testing, each vial is reheated to about 70° C. to allow for the easy insertion of the test specimens. The specimens are inserted into the vial one at a time together with careful wetting of all surfaces with the cable filler grease. After all of the specimens have been inserted, the vials are loosely capped and placed in a 70° C. circulating air oven. Specimens are removed after 4 weeks. The specimens are wiped dean with dry tissue for oxidation induction time (OIT) testing.

OIT testing is accomplished in a differential scanning calorimeter with an OIT test cell. The test conditions are: uncrimped aluminum pan; no screen; heat up to 200° C. under nitrogen, followed by a switch to a 50 milliliter flow of oxygen. Oxidation induction time (OIT) is the time interval between the start of oxygen flow and the exothermic decomposition of the test specimen. OIT is reported in minutes; the greater the number of minutes, the better the OIT. OIT is used as a measure of the oxidative stability of a sample as it proceeds through the cable filler grease exposure and the oxidative aging program. Relative performance in the grease filled cable applications can be predicted by comparing initial sample OIT to OIT values after 70° C. cable filler grease exposure (examples 1 to 11) followed by 90° C. oxidative aging (in examples 12 to 14).

The samples for examples 12 to 14 are prepared by extruding the polyethylene described above blended with the relevant Antioxidants and 0.5 percent by weight (based on the weight of the polyethylene) of the blowing agent azodicarbonamide to provide a 0.008 inch foamed layer of insulation on 24 gauge copper wire. Initial OIT is measured at this time. The samples are then aged for 4 weeks in cable filler grease at 70° C. in the same manner as the above plaques. The samples are removed; wiped clean; and aged in air for 16 weeks at 90° C. The insulation is stripped from the copper wire and subjected to OIT testing at the indicated intervals. As above, OIT testing is accomplished in a differential scanning calorimeter with an OIT test cell. The test conditions are: uncrimped aluminum pan; no screen; heat up to 200° C. under nitrogen, followed by a switch to a 50 milliliter flow of oxygen. OIT is measured after 4, 8, and 20 weeks.

Antioxidant A is tetrakis[methylene (3,5-di-tert-butyl-4-hydroxyhydrocinnamate)]methane. This antioxidant is widely used commercially in grease filled cable.

Antioxidant B is 1,2-bis(3,5-di-tert-butyl-4-hydroxyhydrocinnamoyl)hydrazine.

Antioxidant C is the reaction product of diphenylamine and acetone (CAS registry number 9003-79-6)

Antioxidant D is poly(2,2,4-trimethyl-1,2-dihydroquinoline) (CAS registry number 26780-96-1)

In the Table, the amounts of the antioxidants are given in percent by weight based on the weight of the formulation. The balance of each formulation is polyethylene. The only components of the formulations are polyethylene and the antioxidant(s), and, in examples 12 to 14, a blowing agent.

The OIT results in minutes are also given in the Table.

The experimental results summarized in the Table show the improved performance in examples 1 to 11 with the mixture of Antioxidants B and C or D versus the mixture of Antioxidants A and B; Antioxidant B alone; and Antioxidant D alone, after the exposure to 70° C. cable filler grease. The experimental results summarized in the Table also show the improved performance in examples 12 to 14 with the mixture of Antioxidants B and C or D versus the mixture of Antioxidants A and B after the exposure to 70° C. cable filler grease, and oxidative aging at 90° C. The laboratory results are expected to correspond to improved performance in the commercial grease filled cable application.

TABLE

| Example | 1 | 2 | 3 | 4 | 5 | 6 | 7 |
|---|---|---|---|---|---|---|---|
| A | 0.21 | — | — | — | — | — | — |
| B | 0.54 | 0.54 | 0.54 | 0.30 | 0.50 | 0.50 | — |
| C | — | 0.21 | 0.30 | 0.18 | 0.30 | 0.10 | 0.30 |
| initial OIT | 234 | 300 | 274 | 229 | 267 | 314 | 31 |
| 4 week OIT | 144 | 279 | 269 | 221 | 236 | 216 | 75 |
| **Example** | **8** | **9** | **10** | **11** | **12** | **13** | **14** |
| A | — | — | — | — | 0.21 | — | — |
| B | — | 0.50 | — | 0.50 | 0.54 | 0.54 | 0.54 |
| C | 0.10 | — | — | — | — | 0.30 | — |
| D | — | 0.30 | 0.30 | — | — | — | 0.30 |
| initial OIT | 17 | 300 | 21 | 170 | 237 | 262 | 280 |
| 4 week OIT | 64 | 237 | 18 | 127 | 124 | 239 | 217 |
| 8 week OIT | — | — | — | — | 85 | 184 | 121 |
| 20 week OIT | — | — | — | — | 37 | 128 | 83 |

We claim:

1. An article of manufacture comprising (I) a plurality of electrical conductors having interstices therebetween, each electrical conductor being surrounded by one or more layers comprising a mixture of (i) one or more polyolefins; (ii) a first antioxidant selected from the group consisting of poly(2,2,4-trimethyl-1,2-dihydroquinoline); the reaction product of diphenylamine and acetone; the reaction product of diphenylamine, acetone, and formaldehyde; and mixtures thereof; and (iii) a second antioxidant selected from the group consisting of 2,2'-oxalyldiamido-bis[ethyl-3-( 3,5-di-tert-butyl-4-hydroxyphenyl)propionate]; 1,2-bis(3,5-di-tert-butyl-4-hydroxyhydrocinnamoyl)hydrazine; and mixtures thereof; and (II) hydrocarbon cable filler grease within the interstices.

2. The article of manufacture defined in claim 1 wherein, for each 100 parts by weight of said polyolefins, there are about 0.06 to about 2 parts by weight of combined components (ii) and (iii).

3. The article of manufacture defined in claim 1 wherein said polyolefins are polyethylene or polypropylene.

4. The article of manufacture defined in claim 1 wherein said hydrocarbon cable filler grease or one or more of the hydrocarbon constituents thereof is present in the said mixture of component (i).

5. The article of manufacture defined in claim 4 wherein the total amount of hydrocarbon cable filler grease or one or more of the hydrocarbon constituents thereof present in the mixture of component (i) is in the range of about 3 to about 30 parts by weight based on 100 parts by weight of polyolefin.

6. The article of manufacture defined in claim 1 wherein component (iii) is 1,2-bis(3,5-di-tert-butyl-4-hydroxyhydrocinnamoyl)-hydrazine.

7. The article of manufacture defined in claim 6 wherein component (ii) is poly(2,2,4-trimethyl-1,2-dihydroquinoline) or the reaction product of diphenylamine and acetone.

8. An article of manufacture comprising (I) a plurality of electrical conductors having interstices therebetween, each electrical conductor being surrounded by one or more layers of a mixture comprising (i) polyethylene or polypropylene; (ii) poly(2,2,4-trimethyl-1,2-dihydroquinoline) or the reaction product of diphenylamine and acetone; and (iii) 1,2-bis(3,5-di-tert-butyl-4-hydroxyhydrocinnamoyl)-hydrazine; and (II) hydrocarbon cable filler grease within the interstices.

9. The article of manufacture defined in claim 8 wherein, for each 100 parts by weight of polyolefin, there are about 0.01 to about 1 part by weight of component (ii) and about 0.05 to about 1 part by weight of component (iii).

* * * * *